US011641063B2

(12) United States Patent
Ko et al.

(10) Patent No.: US 11,641,063 B2
(45) Date of Patent: May 2, 2023

(54) BEAMFORMING ANTENNA MODULE COMPRISING LENS

(71) Applicant: Samsung Electronics Co., Ltd., Suwon-si (KR)

(72) Inventors: Seungtae Ko, Suwon-si (KR); Yoongeon Kim, Suwon-si (KR); Hyunjin Kim, Suwon-si (KR); Jinsu Heo, Suwon-si (KR); Youngju Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/767,860

(22) PCT Filed: Nov. 19, 2018

(86) PCT No.: PCT/KR2018/014199
§ 371 (c)(1),
(2) Date: May 28, 2020

(87) PCT Pub. No.: WO2019/124759
PCT Pub. Date: Jun. 27, 2019

(65) Prior Publication Data

US 2020/0350692 A1 Nov. 5, 2020

(30) Foreign Application Priority Data

Dec. 19, 2017 (KR) ..... 10-2017-0175524

(51) Int. Cl.
*H01Q 15/02* (2006.01)
*H01Q 1/24* (2006.01)
(Continued)

(52) U.S. Cl.
CPC ..... *H01Q 15/02* (2013.01); *H01Q 1/243* (2013.01); *H01Q 19/104* (2013.01); *H01Q 21/061* (2013.01)

(58) Field of Classification Search
CPC .... H01Q 1/243; H01Q 19/104; H01Q 19/065; H01Q 19/062; H01Q 21/061;
(Continued)

(56) References Cited

U.S. PATENT DOCUMENTS 3,835,469 A * 9/1974 Chen ..... H01Q 15/02 343/754
6,246,375 B1 * 6/2001 Yamada ..... H01Q 3/14 343/753
(Continued)

FOREIGN PATENT DOCUMENTS

CN 1188995 A 7/1998
CN 105742824 A 7/2016
(Continued)

OTHER PUBLICATIONS

European Search Report dated Nov. 6, 2020, issued in European Application No. 18892962.4.
(Continued)

*Primary Examiner* — Awat M Salih
(74) *Attorney, Agent, or Firm* — Jefferson IP Law, LLP

(57) ABSTRACT

The present invention relates to a communication technique for fusing a 5G communication system to support a higher data transmission rate than a 4G system, with IoT technology, and a system thereof. This disclosure is based on 5G communication technology and the IoT related technology and can be applied to intelligent services (for example, smart home, smart building, smart city, smart car or connected car, healthcare, digital education, retail, security, safety-related services, or the like). In addition, the present invention
(Continued)

provides an antenna module comprising an antenna and a lens, wherein the antenna comprises a first antenna array which deflects and radiates a radio wave from a vertical plane of the antenna by a predetermined first angle, and the lens can be spaced apart from the antenna by a first determined distance to change the phase of the radio wave radiated from the antenna.

12 Claims, 11 Drawing Sheets

(51) Int. Cl.
*H01Q 19/10* (2006.01)
*H01Q 21/06* (2006.01)

(58) Field of Classification Search
CPC ..... H01Q 21/065; H01Q 15/02; H01Q 15/10; H01Q 3/26; H01Q 3/30; H04B 7/0617
See application file for complete search history.

(56) References Cited

U.S. PATENT DOCUMENTS

| | | | | |
|---|---|---|---|---|
| 6,362,795 | B2 | 3/2002 | Ishikawa et al. | |
| 6,556,349 | B2 | 4/2003 | Cox et al. | |
| 7,724,180 | B2 | 5/2010 | Yonak et al. | |
| 9,425,513 | B2 | 8/2016 | Oh et al. | |
| 10,573,966 | B2 | 2/2020 | Ko et al. | |
| 2008/0272955 | A1* | 11/2008 | Yonak | H01Q 15/0086 342/54 |
| 2009/0315794 | A1* | 12/2009 | Alamouti | H01Q 1/007 343/753 |
| 2010/0039339 | A1 | 2/2010 | Kuroda et al. | |
| 2010/0271278 | A1 | 10/2010 | Binzer et al. | |
| 2012/0274525 | A1* | 11/2012 | Lam | H01Q 15/14 343/754 |
| 2014/0313090 | A1 | 10/2014 | Oh et al. | |
| 2015/0200452 | A1 | 7/2015 | Oh et al. | |
| 2016/0240923 | A1* | 8/2016 | Oh | H01Q 21/061 |
| 2017/0062944 | A1* | 3/2017 | Zimmerman | H01Q 1/246 |
| 2017/0201014 | A1* | 7/2017 | Lee | H01Q 1/44 |
| 2017/0271762 | A1 | 9/2017 | Ko et al. | |
| 2020/0021034 | A1 | 1/2020 | Ko et al. | |

FOREIGN PATENT DOCUMENTS

| | | | |
|---|---|---|---|
| CN | 107275803 | A | 10/2017 |
| EP | 1 014 484 | A1 | 6/2000 |
| JP | 2010-526318 | A | 7/2010 |
| JP | 2012-222545 | A | 11/2012 |
| KR | 10-2017-0019932 | A | 2/2017 |
| KR | 10-2017-0082799 | A | 7/2017 |
| KR | 10-2017-0108365 | A | 9/2017 |
| KR | 10-2018-0096287 | A | 8/2018 |
| KR | 10-2018-0096362 | A | 8/2018 |
| WO | 2016/106631 | A1 | 7/2016 |
| WO | 2017/119643 | A1 | 7/2017 |

OTHER PUBLICATIONS

Korean Office Action with English translation dated Oct. 27, 2022; Korean Appln. No. 10-2017-0175524.
Chinese Office Action with English translation dated Mar. 6, 2023; Chinese Appln. No. 201880075918.9.

* cited by examiner

BEAMFORMING ANTENNA MODULE COMPRISING LENS

TECHNICAL FIELD

The present disclosure relates to a beamforming antenna structure including a lens to ensure high gain and coverage in a 5G communication system.

BACKGROUND ART

To meet the demand for wireless data traffic having increased since deployment of 4G communication systems, efforts have been made to develop an improved 5G or pre-5G communication system. Therefore, the 5G or pre-5G communication system is also called a 'Beyond 4G Network' or a 'Post LTE System'. The 5G communication system is considered to be implemented in higher frequency (mmWave) bands, e.g., 60 GHz bands, so as to accomplish higher data rates. To decrease propagation loss of the radio waves and increase the transmission distance, the beamforming, massive multiple-input multiple-output (MIMO), Full Dimensional MIMO (FD-MIMO), array antenna, an analog beam forming, large scale antenna techniques are discussed in 5G communication systems. In addition, in 5G communication systems, development for system network improvement is under way based on advanced small cells, cloud Radio Access Networks (RANs), ultra-dense networks, device-to-device (D2D) communication, wireless backhaul, moving network, cooperative communication, Coordinated Multi-Points (CoMP), reception-end interference cancellation and the like. In the 5G system, Hybrid FSK and QAM Modulation (FQAM) and sliding window superposition coding (SWSC) as an advanced coding modulation (ACM), and filter bank multi carrier (FBMC), non-orthogonal multiple access (NOMA), and sparse code multiple access (SCMA) as an advanced access technology have been developed.

The Internet, which is a human centered connectivity network where humans generate and consume information, is now evolving to the Internet of Things (IoT) where distributed entities, such as things, exchange and process information without human intervention. The Internet of Everything (IoE), which is a combination of the IoT technology and the Big Data processing technology through connection with a cloud server, has emerged. As technology elements, such as "sensing technology", "wired/wireless communication and network infrastructure", "service interface technology", and "Security technology" have been demanded for IoT implementation, a sensor network, a Machine-to-Machine (M2M) communication, Machine Type Communication (MTC), and so forth have been recently researched. Such an IoT environment may provide intelligent Internet technology services that create a new value to human life by collecting and analyzing data generated among connected things. IoT may be applied to a variety of fields including smart home, smart building, smart city, smart car or connected cars, smart grid, health care, smart appliances and advanced medical services through convergence and combination between existing Information Technology (IT) and various industrial applications.

In line with this, various attempts have been made to apply 5G communication systems to IoT networks. For example, technologies such as a sensor network, Machine Type Communication (MTC), and Machine-to-Machine (M2M) communication may be implemented by beamforming, MIMO, and array antennas. Application of a cloud Radio Access Network (RAN) as the above-described Big Data processing technology may also be considered to be as an example of convergence between the 5G technology and the IoT technology.

DISCLOSURE OF INVENTION

Technical Problem

In the above-mentioned multi-input multi-output (MIMO) communication environment, a single antenna may include a plurality of antenna arrays, and a lens for improving the gain and coverage of radio waves may be attached to each antenna array.

The lens is a device that improves the performance of the antenna array by changing the phase of radio waves radiated through the antenna array, so that the structure of the lens may be determined generally based on the antenna or antenna array combined with the lens.

Solution to Problem

An antenna module according to the disclosure may include an antenna including at least one antenna array disposed therein, and a lens. The antenna may include a first antenna array that radiates a radio wave deflected at a predetermined first angle from a vertical plane of the antenna. The lens may be spaced apart from the antenna by a predetermined first distance and may change a phase of the radio wave radiated from the antenna.

The first angle may be determined based on the first distance or a width of the first antenna array.

The antenna may further include a second antenna array spaced apart from the first antenna array by a predetermined second distance, and the second antenna array may radiate a radio wave deflected at the first angle from the vertical plane of the antenna.

The antenna module of claim 3, wherein the first angle may be determined based on the first distance, a width of the first antenna array, or the second distance.

The lens may be a planar lens and formed integrally to cover an upper surface of the antenna.

A central axis of a radio wave phase of the antenna may be determined based on a central axis of the first antenna array and a central axis of the second antenna array, and a central axis of the lens may coincide with the central axis of the radio wave phase of the antenna.

A central axis of radio wave intensity of the first antenna array and a central axis of radio wave intensity of the second antenna array may be deflected by the first angle from the vertical plane of the antenna.

In a base station including an antenna module according to the disclosure, the antenna module may include an antenna including at least one antenna array disposed therein, and a lens. The antenna may include a first antenna array that radiates a radio wave deflected at a predetermined first angle from a vertical plane of the antenna.

The lens may be spaced apart from the antenna by a predetermined first distance and may change a phase of the radio wave radiated from the antenna.

The first angle may be determined based on the first distance or a width of the first antenna array.

The antenna may further include a second antenna array spaced apart from the first antenna array by a predetermined second distance, and the second antenna array may radiate a radio wave deflected at the first angle from the vertical plane of the antenna.

The first angle may be determined based on the first distance, a width of the first antenna array, or the second distance.

The lens may be a planar lens and formed integrally to cover an upper surface of the antenna.

A central axis of a radio wave phase of the antenna may be determined based on a central axis of the first antenna array and a central axis of the second antenna array, and a central axis of the lens may coincide with the central axis of the radio wave phase of the antenna.

A central axis of radio wave intensity of the first antenna array and a central axis of radio wave intensity of the second antenna array may be deflected by the first angle from the vertical plane of the antenna.

Advantageous Effects of Invention

According to an embodiment of the disclosure, a phase distribution center of the antenna can coincide with a phase distribution center of the lens, so that it is possible to prevent a beam radiated through the antenna from being distorted even though a plurality of antenna arrays are disposed in one antenna.

MODE FOR THE INVENTION

Figure 1:
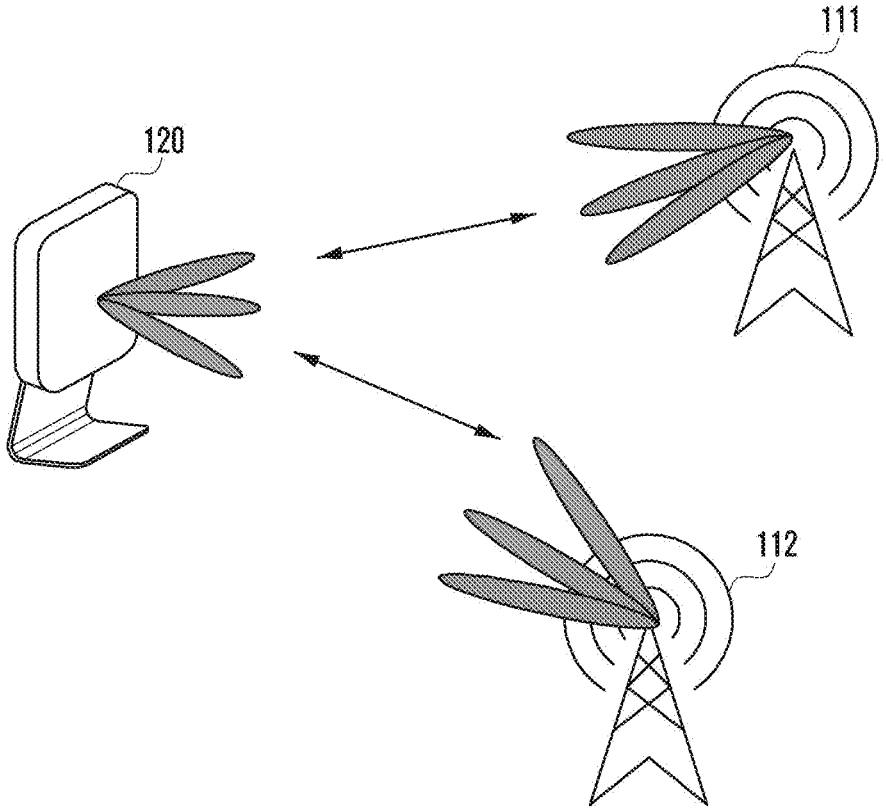
FIG. 1 is a diagram illustrating a mobile communication system that supports beamforming

In the following description of embodiments, descriptions of techniques that are well known in the art and not directly related to the present invention are omitted. This is to clearly convey the subject matter of the disclosure by omitting any unnecessary explanation.

For the same reason, some elements in the drawings are exaggerated, omitted, or schematically illustrated. Also, the size of each element does not entirely reflect the actual size. In the drawings, the same or corresponding elements are denoted by the same reference numerals.

The advantages and features of the disclosure and the manner of achieving them will become apparent with reference to embodiments described in detail below and with reference to the accompanying drawings. The disclosure may, however, be embodied in many different forms and should not be construed as being limited to the embodiments set forth herein. Rather, these embodiments are provided so that the disclosure will be thorough and complete and will fully convey the scope of the disclosure to those skilled in the art. To fully disclose the scope of the disclosure to those skilled in the art, the disclosure is only defined by the scope of claims. In the disclosure, similar reference numbers are used to indicate similar constituent elements.

It will be understood that each block of the flowchart illustrations, and combinations of blocks in the flowchart illustrations, may be implemented by computer program instructions. These computer program instructions may be provided to a processor of a general purpose computer, special purpose computer, or other programmable data processing apparatus to produce a machine, such that the instructions, which are executed via the processor of the computer or other programmable data processing apparatus, generate means for implementing the functions specified in the flowchart block or blocks. These computer program instructions may also be stored in a computer usable or computer-readable memory that may direct a computer or other programmable data processing apparatus to function in a particular manner, such that the instructions stored in the computer usable or computer-readable memory produce an article of manufacture including instruction means that implement the function specified in the flowchart block or blocks. The computer program instructions may also be loaded onto a computer or other programmable data processing apparatus to cause a series of operational steps to be performed on the computer or other programmable apparatus to produce a computer implemented process such that the instructions that are executed on the computer or other programmable apparatus provide steps for implementing the functions specified in the flowchart block or blocks.

In addition, each block of the flowchart illustrations may represent a module, segment, or portion of code, which comprises one or more executable instructions for implementing the specified logical function(s). It should also be noted that in some alternative implementations, the functions noted in the blocks may occur out of the order. For example, two blocks shown in succession may in fact be executed substantially concurrently or the blocks may sometimes be executed in the reverse order, depending upon the functionality involved.

The term "unit", as used herein, refers to a software or hardware component or device, such as a field programmable gate array (FPGA) or application specific integrated circuit (ASIC), which performs certain tasks. A unit may be configured to reside on an addressable storage medium and configured to execute on one or more processors. Thus, a module or unit may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The functionality provided for in the components and units may be combined into fewer components and units or further separated into additional components and modules. In addition, the components and units may be implemented to operate one or more central processing units (CPUs) in a device or a secure multimedia card. Also, in embodiments, the unit may include one or more processors.

FIG. 1 is a diagram illustrating a mobile communication system that supports beamforming.

Shown is communication between each of a plurality of base stations 111 and 112 and a communication device 120 including an antenna module according to the disclosure. As described above, the 5G mobile communication may have a wide frequency bandwidth.

On the other hand, the gain and coverage of radio waves transmitted from the base stations 111 and 112 or the communication device 120 may become poor. Therefore, in order to solve this problem, the 5G mobile communication system basically uses a beamforming technique.

That is, the base stations 111 and 112 or the communication device 120 including an antenna module supporting the 5G mobile communication system may form beams at various angles, and perform communication using a beam having the best communication environment from among the formed beams.

Referring to FIG. 1 as an example, the communication device 120 may form three kinds of beams radiated at different angles, and correspondingly the base station may also form three kinds of beams radiated at different angles. For example, the communication device 120 may radiate three kinds of beams having beam indexes 1, 2, and 3, the first base station 111 may radiate three kinds of beams having beam indexes 4, 5, and 6, and the second base station 112 may radiate three kinds of beams having beam indexes 7, 8, and 9.

In this case, through communication between the communication device 120 and the first and second base stations 111 and 112, the communication device and the first base station may perform communication through beams having the best communication environment, e.g., a beam having a beam index 2 of the communication device 120 and a beam having a beam index 5 of the first base station 111. In the same manner, the communication device 120 and the second base station 112 may perform communication.

Meanwhile, FIG. 1 shows only one example in which the 5G communication system can be applied. That is, the number of beams that can be radiated by the communication device or the base station may be increased or decreased, so that the scope of the disclosure should not be limited to the number of beams shown in FIG. 1.

The communication device 120 shown in FIG. 1 includes various kinds of devices capable of performing communication with the base station. For example, such devices may include customer premises equipment (CPE) or a wireless repeater.

Figure 2:
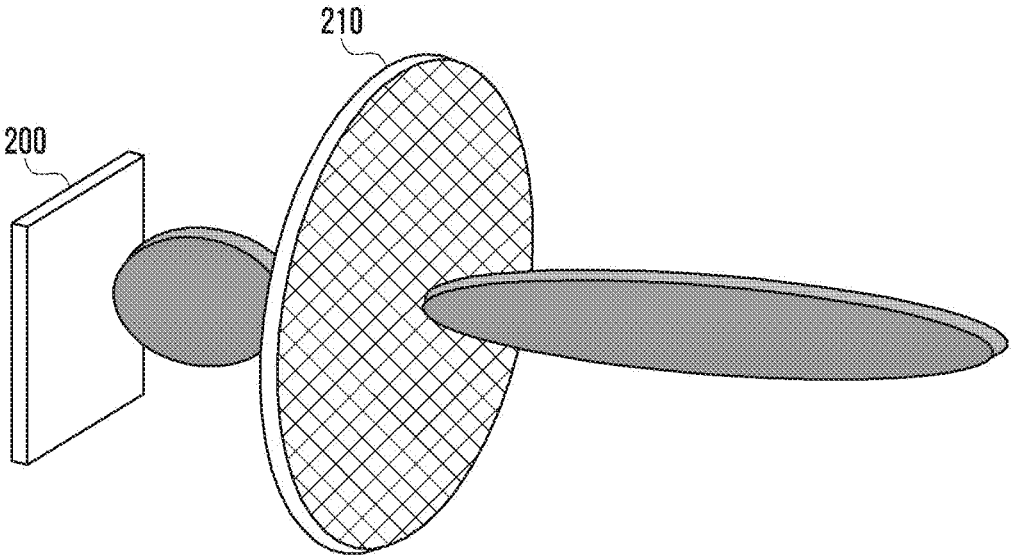
FIG. 2 is a diagram illustrating a structure of an antenna module including a lens.

FIG. 2 is a diagram illustrating a structure of an antenna module including a lens.

The antenna module according to the disclosure may include an antenna 200 including at least one antenna array and a lens 210. That is, the antenna 200 according to the disclosure may include a plurality of antenna arrays. For example, one antenna 200 may include four antenna arrays, and an angle of a beam radiated through the antenna 200 may be determined finally by adjusting an angle of a beam radiated through each of the antenna arrays.

The beam radiated through the antenna 200 may pass through the lens 210 spaced apart from the antenna 200 by a predetermined distance. The lens 210 may change a phase of a beam (or radio wave) incident on the lens.

Specifically, the lens 210 may change phase values of beams incident on the lens 210 to the same phase value through a pattern formed on the lens, and then radiate them to the outside of the lens 210.

Therefore, the beam radiated to the outside through the lens 210 has a sharper shape than that of the beam radiated through the antenna 200. That is, using the lens 210 can improve the gain value of the beam radiated through the antenna 200. A more detailed description about the gain value improvement and phase change of the beam using the lens 210 will be described below with reference to FIGS. 3A to 3C.

Figure 3A:
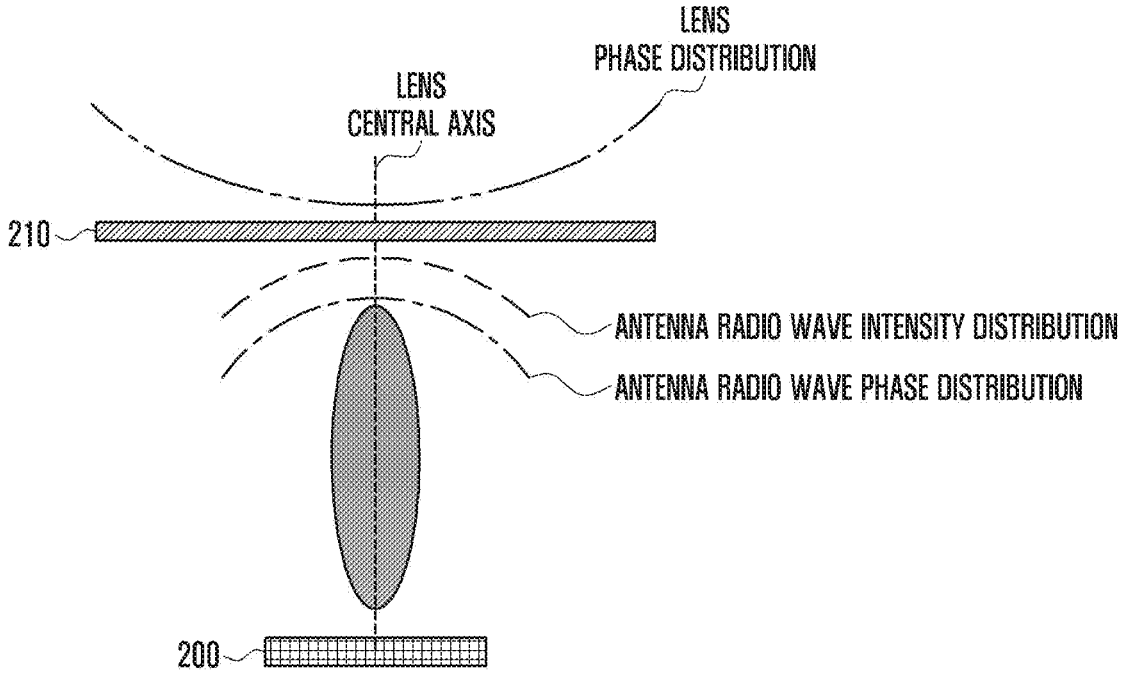
FIG. 3A is a diagram illustrating a structure of an antenna module when one antenna array is disposed in an antenna.

FIG. 3A is a diagram illustrating a structure of an antenna module when one antenna array is disposed in an antenna.

When only one antenna array 200 is disposed in the antenna, radio waves (or a beam) radiated through the antenna array 200 may have a shape as shown in FIG. 3A. In addition, the intensity distribution and phase distribution of the radio waves may have a parabolic shape around a central axis of the radio waves as shown in FIG. 3A.

Meanwhile, the lens 210 spaced apart from the antenna array 200 by a predetermined distance may be disposed such that the central axis of the radio waves and the central axis of the lens coincide with each other. In this case, the phase distribution of the lens 210 may be a parabola having a shape opposite to the phase distribution of the radio waves. (The phase distribution of the lens may be determined through a pattern formed on the lens as described above. A method of forming the lens pattern for determining the phase distribution is out of the scope of the disclosure, so that a detailed description thereof is omitted.)

That is, in the structure of the antenna module shown in FIG. 3A, the central axis of the lens and the central axis of the radio waves coincide with each other, and also all of the center of the lens phase distribution, the center of the antenna radio wave phase distribution, and the center of the antenna radio wave intensity distribution coincide with each other.

Figure 3B:
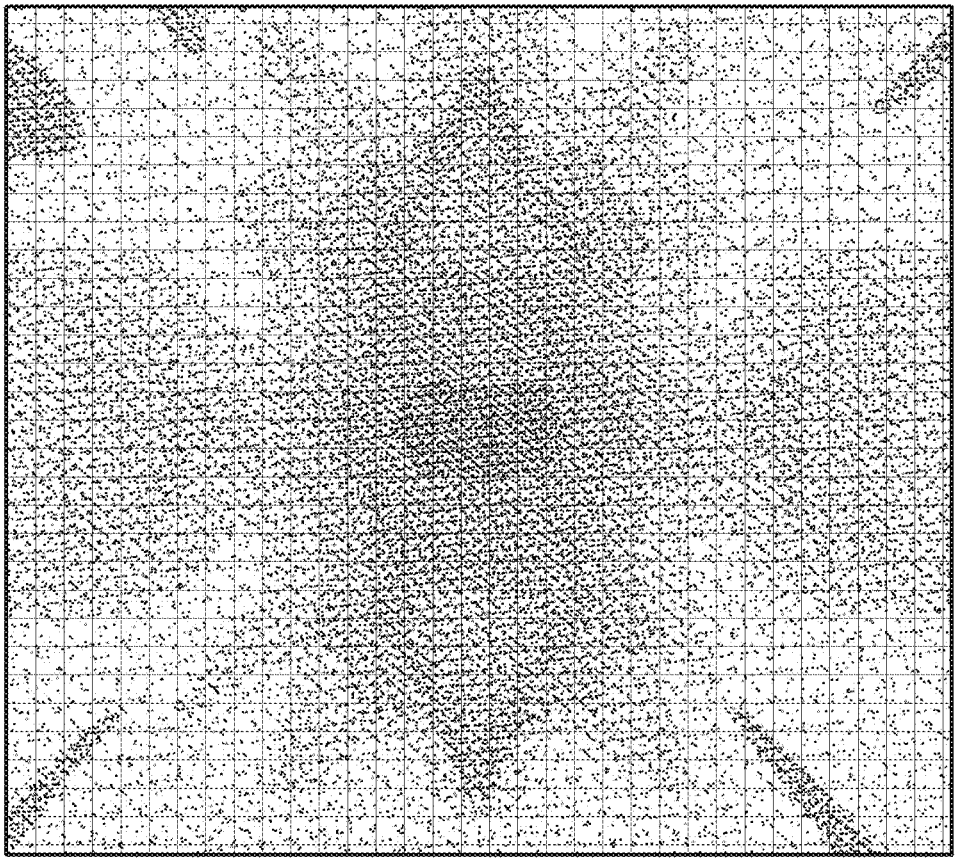
FIG. 3B is a diagram illustrating an intensity distribution of a beam radiated through a lens when one antenna array is disposed in an antenna.
Figure 3C:
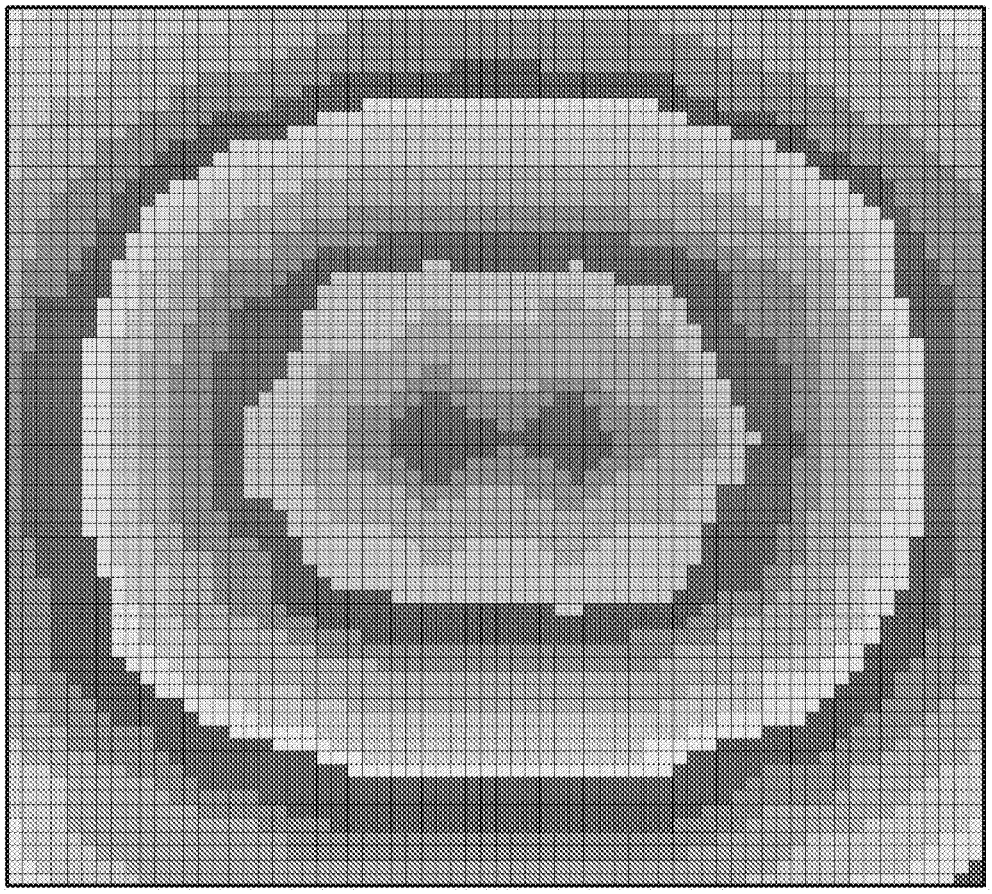
FIG. 3C is a diagram illustrating a phase distribution of a beam radiated through a lens when one antenna array is disposed in an antenna.

In case of the antenna module structure disclosed in FIG. 3A, the intensity distribution of the beam radiated through the lens is shown in FIG. 3B, and the phase distribution of the beam is shown in FIG. 3C.

Through FIGS. 3B and 3C, it can be seen that the gain value of the radio wave radiated through the lens is greater as it is closer to the central axis of the lens, and it can be also seen that the phase value of the radio wave is formed such that the central axis of the lens and the central axis of the radio wave coincide with each other.

Meanwhile, a single antenna may include a plurality of antenna arrays. Particularly, in the multi-input multi-output (MIMO) communication environment, a need for the antenna including the plurality of antenna arrays increases.

Figure 4:
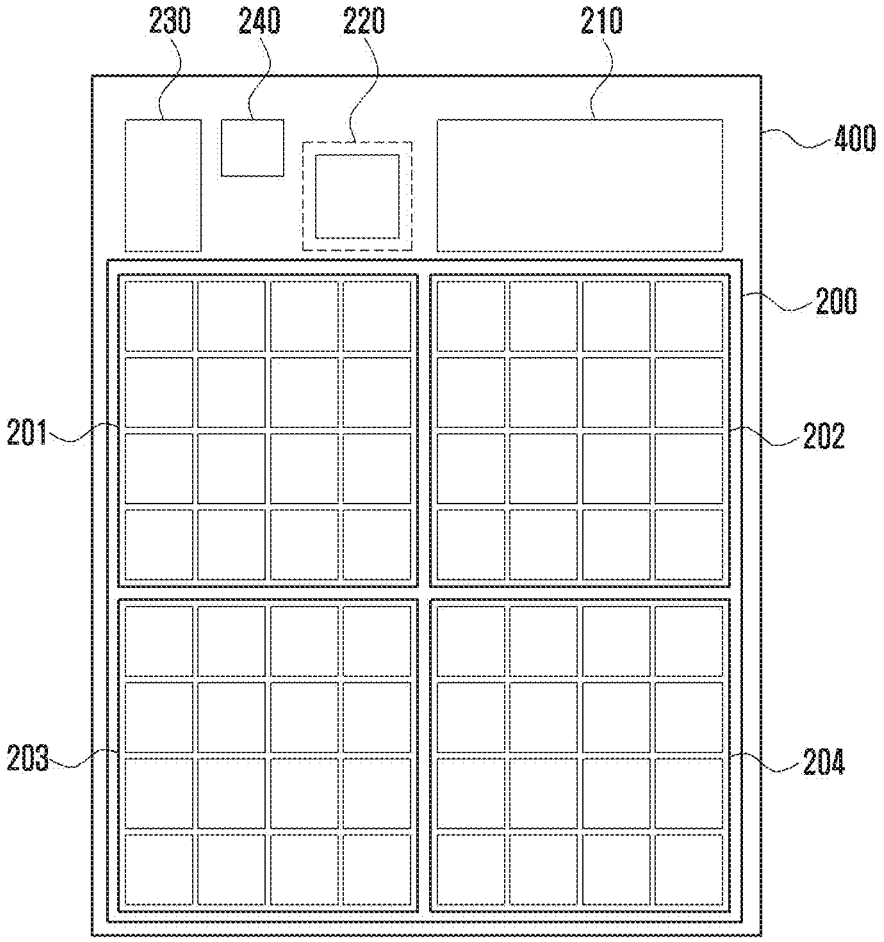
FIG. 4 is a diagram illustrating a configuration of an antenna module when a plurality of antenna arrays are disposed in an antenna according to an embodiment of the disclosure.

FIG. 4 is a diagram illustrating a configuration of an antenna module when a plurality of antenna arrays are disposed in an antenna according to an embodiment of the disclosure.

An antenna module 400 according to the disclosure may include an antenna 200 that includes at least one of antenna array 201, 202, 203, and 204. Each antenna array 201, 202, 203, and 204 may include a plurality of antenna elements. For example, one antenna array may be composed of 16 antenna elements as shown in FIG. 4, and the antenna array may form beams at various angles by controlling the respective antenna elements.

In addition, the antenna module 400 may further include various components as necessary. For example, the antenna module 400 may further include a connector 230 for providing power to the antenna module 400, and a DC/DC converter 210 for converting a voltage provided through the connector 230.

In addition, the antenna module 400 may further include a field programmable gate array (FPGA) 220. The FPGA 220 is a semiconductor device including a programmable logic device and programmable interconnects. The programmable logic device may be programmed by replicating logic gates such as AND, OR, XOR, and NOT and more complex decoder functions. The FPGA may also include a flip-flop or memory.

In addition, the antenna module 400 may include a low dropout (LDO) regulator 240. The LDO regulator 240 is a regulator that is highly efficient when an output voltage is lower than and very close to an input voltage, and may remove noise of input power. As having low output impedance, the LDO regulator 240 may have a function of stabilizing a circuit by placing a dominant pole in the circuit.

Meanwhile, FIG. 4 merely shows the structure of the antenna module according to an embodiment of the disclosure, so that the scope of the disclosure should not be limited to that.

That is, FIG. 4 shows a case where four antenna arrays constitute one antenna, but the number of antenna arrays included in one antenna may be increased or decreased as necessary. In addition, the aforementioned connector 230, DC/DC converter 210, FPGA 220, or LDO regulator 240 may be added or removed as needed.

Figure 5A:
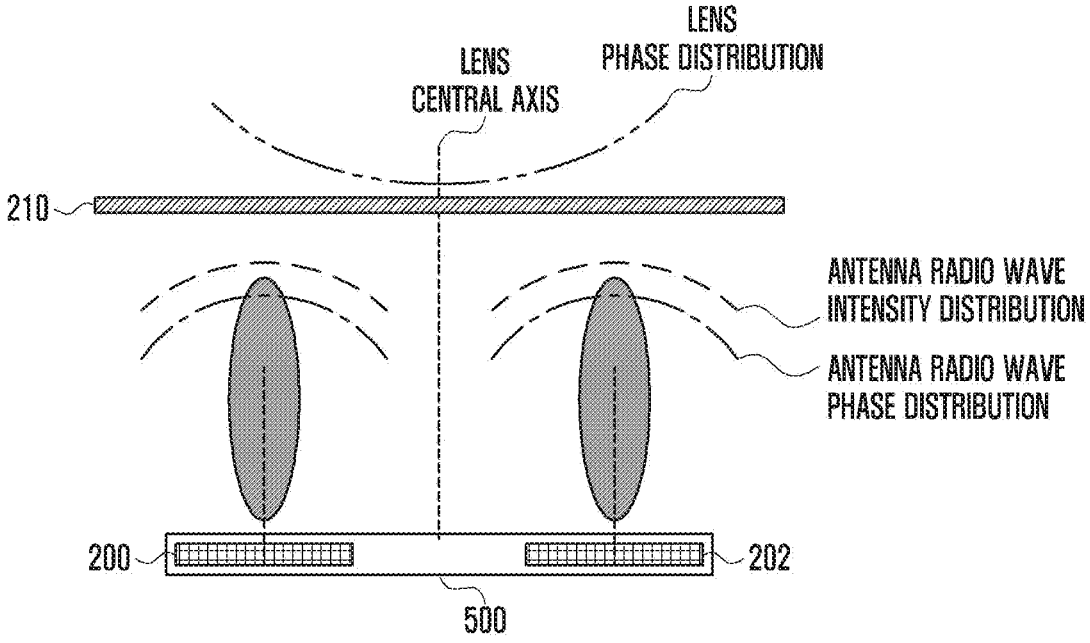
FIG. 5A is a diagram illustrating a structure of an antenna module when a plurality of antenna arrays are disposed in an antenna.

When a plurality of antenna arrays are included in one antenna as shown in FIG. 4, the structure of the antenna module including the antenna and the lens is shown in FIG. 5A. Specifically, FIG. 5A shows a case where two antenna arrays 200 and 202 are included in one antenna 500.

The first antenna array 200 and the second antenna array 202 constituting the one antenna 500 are spaced apart from each other by a predetermined distance, and each of the first and second antenna arrays 200 and 202 may radiate radio waves toward the lens 210.

As can be seen from FIG. 5A, in the configuration of the antenna module including the first and second antenna arrays 200 and 202, the central axis of the lens 210 does not coincide with the radio wave central axis of the first antenna array 200 and the radio wave central axis of the second antenna array 202.

This is because the first antenna array 200 and the second antenna array 202 cannot be located to be physically overlapped with each other. Therefore, radio waves radiated through the first and second antenna arrays 200 and 202 do not overlap and, as shown in FIG. 5A, are spaced apart from each other.

That is, an antenna radio wave angle distribution and an antenna radio wave phase distribution of radio waves radiated through the first antenna array 200 do not coincide with an antenna radio wave angle distribution and an antenna radio wave phase distribution of radio waves radiated through the second antenna array 202.

In addition, the sum of the phase distribution of radio waves radiated through the first antenna array 200 and the phase distribution of radio waves radiated through the second antenna array 202 is not opposite to a phase distribution of the lens. As a result, the performance of the lens (gain value improvement and coverage improvement) may be degraded. (A condition that can maximize the performance of the lens is a case where a parabola formed by the antenna radio wave phase distribution and a parabola formed by the lens phase distribution are opposite to each other as described in FIG. 3A.)

Figure 5B:
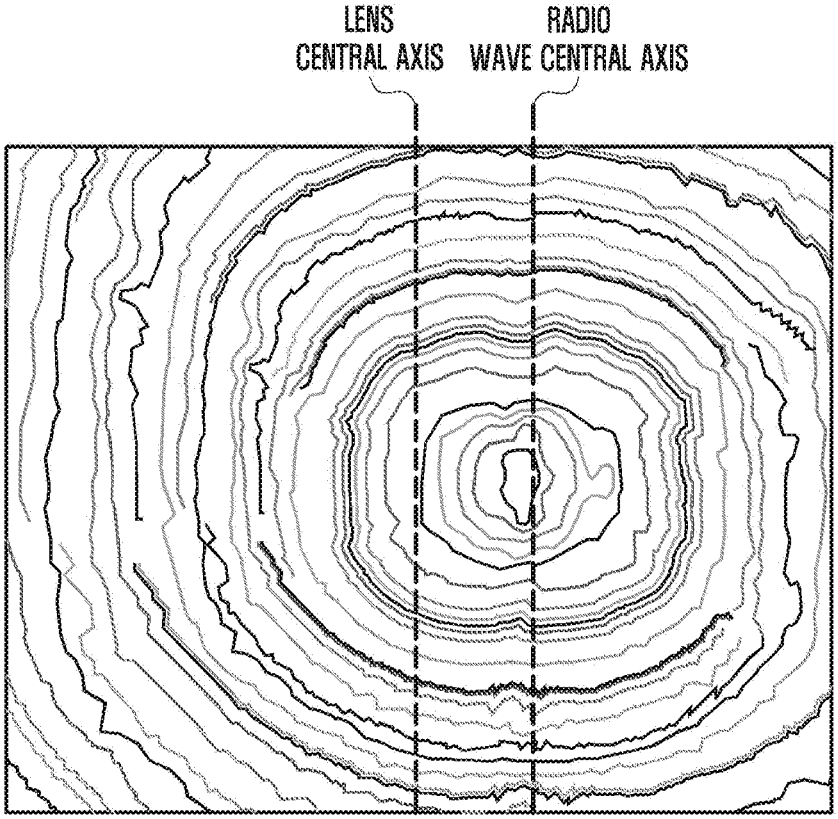
FIG. 5B is a diagram illustrating a phase distribution of a beam radiated through a lens when a plurality of antenna arrays are disposed in an antenna.
Figure 5C:
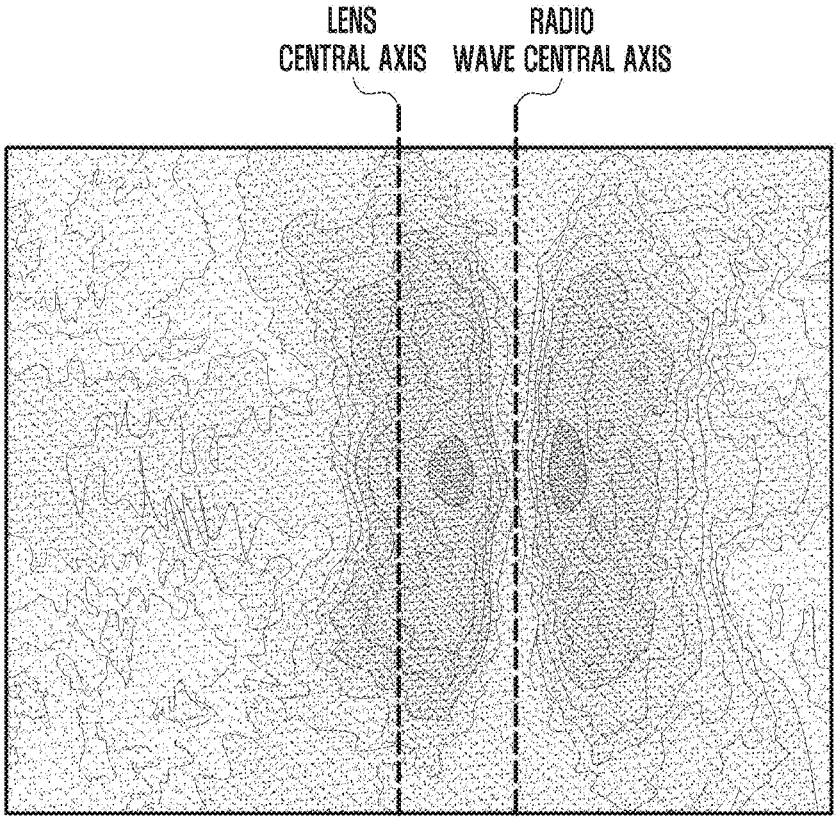
FIG. 5C is a diagram illustrating an intensity distribution of a beam radiated through a lens when a plurality of antenna arrays are disposed in an antenna.

FIG. 5B is a diagram illustrating a phase distribution of a beam radiated through a lens in the antenna module structure shown in FIG. 5A, and FIG. 5C is a diagram illustrating an intensity distribution of a beam radiated through a lens in the antenna module structure shown in FIG. 5A.

As can be seen from FIGS. 5B and 5C, the lens central axis does not coincide with the axis of radio waves radiated from the antenna including the first and second antenna arrays.

Accordingly, the intensity of radio waves radiated through the lens is evenly distributed from side to side around the central axis of the lens and the central axis of the antenna radio waves, so that the beam radiated through the lens may not have a sharp shape. (That is, the gain value improved through the lens may decrease.)

Figure 6:
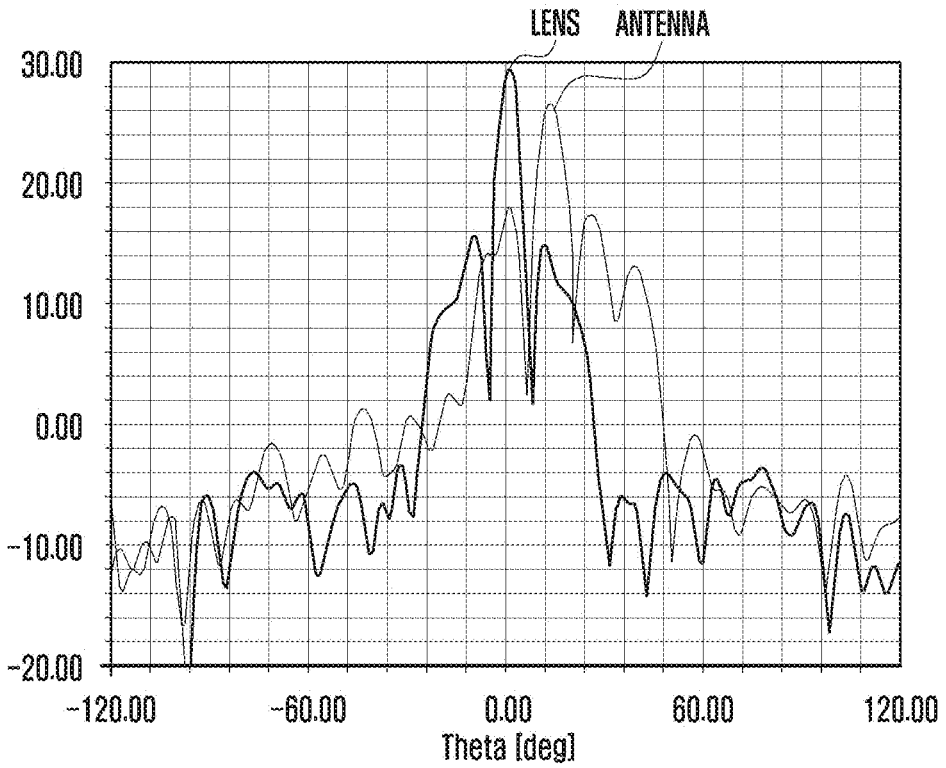
FIG. 6 is a graph showing a phase difference between a beam radiated from an antenna and a beam radiated through a lens when a plurality of antenna arrays are disposed in the antenna.

FIG. 6 is a graph showing a phase difference between a beam radiated from an antenna and a beam radiated through a lens when a plurality of antenna arrays are disposed in the antenna. In addition to the above-mentioned decrease of the radio wave gain value, another problem may be caused in the structure shown in FIG. 5A. This can be seen through the graph of FIG. 6.

Referring to the graph of FIG. 6, the phase distribution of the lens (labeled as 'LENS' in the graph) and the phase distribution of radio waves radiated from the antenna (labeled as 'ANTENNA' in the graph) are different from each other. Specifically, the phase distribution of the lens is formed to have a peak at an incidence angle of zero degree with respect to the central axis of the lens, whereas the phase distribution of radio waves radiated from the antenna is formed to have a peak at an incidence angle of about 12 degrees with respect to the central axis of the lens.

As such, in the antenna module structure as shown in FIG. 5A, the antenna central axis and the lens central axis may not coincide with each other, so that the antenna module may be difficult to form a beam at an accurate angle. (As mentioned above, the 5G mobile communication system uses the beamforming technology that forms a plurality of beams at predetermined angular intervals. Therefore, incapability of forming the plurality of beams at accurate angles is a serious issue in applying the 5G mobile communication system.)

Figure 7:
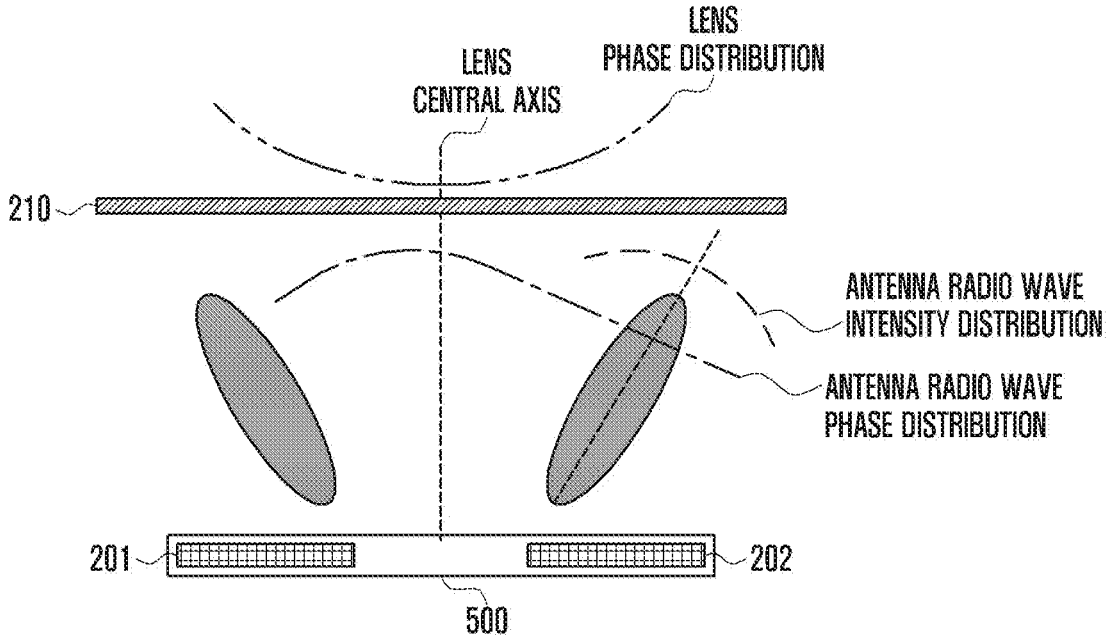
FIG. 7 is a view showing a case in which a plurality of antenna arrays are disposed in an antenna and each antenna array deflects and radiates a beam by a predetermined angle.

FIG. 7 is a view showing a case in which a plurality of antenna arrays are disposed in an antenna and each antenna array deflects and radiates a beam by a predetermined angle.

As described above, the antenna module shown in FIG. 5A has a problem that the phase distribution of radio waves radiated through the antenna does not correspond to the lens phase distribution because the antenna includes a plurality of antenna arrays.

Accordingly, this disclosure is intended to control radio wave radiation angles of the first and second antenna arrays 201 and 202 constituting the antenna 500 such that the phase distribution of radio waves radiated through the antenna corresponds to the lens phase distribution.

Specifically, as shown in FIG. 7, radio waves radiated through the first antenna array 201 and radio waves radiated through the second antenna array 202 are combined to form radio waves radiated through the antenna 500. A parabola formed by the phase distribution of the radio waves radiated through the antenna 500 is opposite to a parabola formed by the lens phase distribution around the lens 210. That is, the first and second antenna arrays 201 and 202 may be controlled such that the central axis of the antenna radio wave phase distribution and the central axis of the lens coincide with each other.

For example, each of the first and second antenna arrays 201 and 202 may radiate radio waves deflected at a predetermined first angle from a vertical plane of the antenna, and the first angle may be determined based on a distance between the antenna array and the lens, a width of the antenna array, or a distance between the antenna arrays.

Specifically, the first angle for deflection may be determined according to the following Equation.

$$\theta=\tan^{-1}((W+p)/(2*D)) \quad \text{Equation}$$

θ: first angle, W: antenna array width, D: distance between antenna array and lens, p: distance between antenna arrays Meanwhile, although only a case where two antenna arrays are included in one antenna is disclosed, the scope of the disclosure should not be limited thereto. That is, if necessary, the number of antenna arrays included in the antenna may be increased or decreased.

In addition, although it is described above that the first and second antenna arrays may radiate radio waves deflected at the same first angle, the first and second antenna arrays may also radiate radio waves deflected at different angles as necessary. (However, even in this case, the central axis of the antenna radio wave phase distribution and the central axis of the lens should coincide with each other.)

While the disclosure has been described in detail with reference to specific embodiments, it is to be understood that various changes and modifications may be made without departing from the scope of the disclosure. In addition, the above-described embodiments may be selectively combined with each other if necessary. For example, some of the embodiments proposed in the disclosure may be combined with each other and used by a base station and a terminal.

The invention claimed is:

1. An antenna module comprising:

a plurality of antenna arrays on an antenna plane, the plurality of antenna arrays including a first antenna array and a second antenna array; and a lens including a pattern, wherein the first antenna array radiates a first radio wave deflected at a first predetermined angle from a vertical plane of the antenna for the antenna plane in respect to a side of the vertical plane, wherein the second antenna array radiates a second radio wave deflected at a second predetermined angle from the vertical plane for the antenna plane in respect to another side opposite to the side of the vertical plane, wherein a combined radio wave is formed based on a combination of the first deflected radio wave and the second deflected radio wave, wherein the first predetermined angle and the second predetermined angle are determined such that a central axis of a phase distribution of the combined radio wave is aligned to a central axis of the lens, wherein the first predetermined angle is determined based on a distance between the lens and the antenna plane, a distance between the first antenna array and the second antenna array, and a width of the first antenna array, wherein the second predetermined angle is determined based on the distance between the lens and the antenna plane, the distance between the first antenna array and the second antenna array, and a width of the second antenna array, and wherein the pattern formed on the lens changes phases of the combined radio wave.

2. The antenna module of claim 1, wherein the first predetermined angle ($\theta_1$) is determined based an equation:

$$\theta_1=\tan^{-1}((W_1+p)/(2*D)),$$

wherein the second predetermined angle ($\theta_2$) is determined based on an equation:

$$\theta_2=\tan^{-1}((W_2+p)/(2*D)), \text{ and}$$

wherein 'D' refers to the distance between the lens and the antenna plane, 'p' refers to a distance between the first antenna array and the second antenna array, '$W_1$' refers to the width of the first antenna array, and '$W_2$' refers to the width of the second antenna array.

3. The antenna module of claim 1, wherein the lens comprises a planar lens and formed integrally to cover a whole upper surface of the plurality of antenna arrays.

4. The antenna module of claim 1, wherein a central axis of radio wave intensity of the combined radio wave is aligned to the central axis of the lens.

5. The antenna module of claim 1, wherein a shape formed based on the phase distribution of the combined radio wave is opposite to a shape formed based on a phase distribution of the pattern formed on the lens.

6. The antenna module of claim 1, wherein the phases of the combined radio wave are changed into a same phase value according to the pattern formed on the lens.

7. A base station comprising an antenna module, the antenna module comprising:

a plurality of antenna arrays on an antenna plane, the plurality of antenna arrays including a first antenna array and a second antenna array; and a lens including a pattern, wherein the first antenna array radiates a first radio wave deflected at a first predetermined angle from a vertical plane for the antenna plane in respect to a side of the vertical plane, wherein the second antenna array radiates a second radio wave deflected at a second predetermined angle from the vertical plane for the antenna plane in respect to another side opposite to the side of the vertical plane, wherein a combined radio wave is formed based on a combination of the first deflected radio wave and the second deflected radio wave, wherein the first predetermined angle and the second predetermined angle are determined such that a central axis of a phase distribution of the phases of the combined radio wave is aligned to a central axis of the lens, wherein the first predetermined angle is determined based on a distance between the lens and the antenna plane, a distance between the first antenna array and the second antenna array, and a width of the first antenna array, wherein the second predetermined angle is determined based on the distance between the lens and the antenna plane, the distance between the first antenna array and the second antenna array, and a width of the second antenna array, and wherein the pattern formed on the lens changes phases of the combined radio wave.

8. The base station of claim 7, wherein the first predetermined angle ($\theta_1$) is determined based on an equation:

$$\theta_1=\tan^{-1}((W_1+p)/(2*D)),$$

wherein the second predetermined angle ($\theta_2$) is determined based on an equation:

$$\theta_2=\tan^{-1}((W_2+p)/(2*D)), \text{ and}$$

wherein 'D' refers to the distance between the lens and the antenna plane, 'p' refers to a distance between the first antenna array and the second antenna array, '$W_1$' refers to the width of the first antenna array, and '$W_2$' refers to the width of the second antenna array.

9. The base station of claim 7, wherein the lens comprises a planar lens and formed integrally to cover a whole upper surface of the plurality of antenna arrays.

10. The base station of claim 7, wherein a shape formed by the phase distribution of the combined radio wave is opposite to a shape formed by the phase distribution of the pattern formed on the lens, and wherein a central axis of radio wave intensity of the combined radio wave is aligned to the central axis of the lens.

11. The base station of claim 7, wherein a shape formed based on the phase distribution of the combined radio wave is opposite to a shape formed based on a phase distribution of a pattern formed on the lens.

12. The base station of claim 7, wherein the phases of the combined radio wave are changed into a same phase value according to the pattern formed on the lens.

* * * * *